US005933123A

United States Patent [19]

Kaul

[11] Patent Number: 5,933,123

[45] Date of Patent: Aug. 3, 1999

[54] COMBINED SATELLITE AND TERRESTRIAL ANTENNA

[75] Inventor: John R. Kaul, Lone Rock, Wis.

[73] Assignee: Kaul-Tronics, Inc., Richland Center, Wis.

[21] Appl. No.: 08/984,601

[22] Filed: Dec. 3, 1997

[51] Int. Cl.[6] ..... H01Q 21/00

[52] U.S. Cl. ..... 343/879; 343/725; 343/890; 403/389

[58] Field of Search ..... 343/725, 728, 343/729, 840, 912, DIG. 2, 878, 879, 890, 892; 248/201, 225.31; 403/388, 389

[56] References Cited

U.S. PATENT DOCUMENTS

| | | | |
|---|---|---|---|
| 4,819,007 | 4/1989 | Tezcan | 343/880 |
| 5,392,057 | 2/1995 | Lin | 343/840 |
| 5,402,139 | 3/1995 | Maeshima | 343/840 |
| 5,448,254 | 9/1995 | Schneeman et al. | 343/840 |
| 5,604,508 | 2/1997 | Atkinson . | |

FOREIGN PATENT DOCUMENTS 60-149206 8/1985 Japan .

*Primary Examiner*—Don Wong
*Assistant Examiner*—Tho Phan
*Attorney, Agent, or Firm*—Foley & Lardner

[57] ABSTRACT

A combined satellite and terrestrial antenna has a reflector dish formed of a conductive metal supported by but electrically insulated from a support structure. A pick-up for the satellite transmission signal is also supported by the support structure at a position to receive satellite microwave signals reflected from the dish. An electrical connector is attached to and in electrical contact with the metal of the dish and a transmission line extends from the connector to transmit UHF/VHF signals which are received by the metal dish itself. The UHF/VHF signals may be combined with the signals from the satellite pick-up and transmitted together on a common transmission line leading to a receiver. A loop section may be connected by swivel connectors to the periphery of the reflector dish to be in electrical contact therewith to further enhance the reception of UHF/VHF frequencies. The loop section may be adjusted to a position either in the front or the back of the dish to maximize reception of UHF/VHF signals.

8 Claims, 5 Drawing Sheets

COMBINED SATELLITE AND TERRESTRIAL ANTENNA

FIELD OF THE INVENTION

This invention pertains generally to the field of antennas for receiving television signals, and particularly to antennas for receiving satellite transmissions and terrestrial broadcast transmissions of television signals.

BACKGROUND OF THE INVENTION

The use of satellite antennas for reception of television transmissions from satellites has increased rapidly in recent years. The use of satellite antennas allows households to have access to potentially hundreds of television channels, usually many more than are available through local cable television systems. Satellite antennas have also allowed television transmissions to be accessible to rural households which may not have access to cable television. Generally, however, local television station broadcasts are not made available over the satellite transmission. Thus, for households desiring to watch local over-the-air broadcast channels in addition to channels available through the satellite transmission, a second terrestrial antenna is required to receive the local channels.

The use of two separate antennas, satellite and terrestrial, has certain disadvantages. A first is simply the added costs of two antennas versus one, the cost of purchasing two separate antenna support structures, and the attendant costs of setting up and installing the support structures and the antennas. Mounting two separate antennas in two separate locations also requires that separate cables be run from each antenna location to the location of the television receiver, which also increases the set-up and maintenance costs. Furthermore, the mounting of two separate antennas in two separate locations on or around a home may not be aesthetically pleasing.

One approach to solving the problem of two separately mounted antennas has been to mount the satellite and terrestrial antennas at the same location. The satellite and terrestrial antennas may then share the same support structures, as well as much of the wiring necessary to connect the antennas to a television receiver. One example of a combined mounting of a terrestrial and satellite antenna at a single location is the Tennamount™ is mounting system, which is designed to attach a conventional terrestrial dipole antenna to the support structure of a large (72"–120" diameter) satellite dish antenna.

More recent satellite television systems receive digital television signals from a satellite, providing higher quality video and sound, and featuring smaller (e.g., 18" diameter) satellite dish antennas which may be conveniently mounted on the wall or roof of a house. The smaller size and more convenient mounting capabilities of such antennas are significant advantages over the earlier, large diameter satellite dishes which typically were mounted separately from the house, such as on a heavy support post mounted in a concrete footing in the ground. The newer digital satellite television systems still typically do not provide access to local television broadcast channels, so that it is still necessary to use a terrestrial antenna in addition to the digital satellite antenna to allow reception of such broadcast signals. An antenna support assembly for supporting both the digital satellite reception antenna and a terrestrial antenna at a single location, where both antennas may be coupled to a single cable leading to the interior of the house, is shown in U.S. Pat. No. 5,604,508. In such a system, two separate antennas, one for receiving terrestrial broadcast signals and the other for receiving the digital satellite signals, are still required.

In one type of antenna system developed to combine a terrestrial antenna into the satellite dish antenna, the reflector dish of the antenna is formed of fiberglass, and a "bow tie" type terrestrial antenna is embedded into the surface of the fiberglass reflector dish. Signals from the satellite signal pick-up of the satellite dish system may be combined with signals from the terrestrial antenna and brought back to the receiver within the house on a common cable. Such systems have a higher manufacturing cost than the satellite antenna alone because of the additional cost of the terrestrial antenna itself and the cost of forming the terrestrial antenna in the reflector dish. Such an antenna design also requires some compromise in the reception obtained with the terrestrial antenna since the reflector dish must be oriented to best receive the satellite signal, which may result in an orientation of the terrestrial antenna which is not optimum for receiving the broadcast television signals.

SUMMARY OF THE INVENTION

The combined satellite and terrestrial antenna in accordance with the present invention has substantially the same external appearance, space requirements, and mounting structure as a conventional satellite antenna system, while providing high quality reception of both satellite and terrestrial television signals. In the present invention, the satellite reflector dish is formed of electrically conductive metal, and is connected to its support structure so as to be electrically insulated from the support structure and thereby to be electrically isolated from the support structure and from ground. In accordance with the invention, the metal reflector dish functions both to reflect the microwave satellite signal to the pick-up for such signals and simultaneously to absorb and receive the lower frequency terrestrial broadcast television signals. A conductor extends from a connector attached to and in electrical contact with the satellite dish, to transfer the broadcast frequency television signals to an interface unit, such as a balun transformer and ground blocks or a diplexer or combiner, that itself may be mounted to the support structure for the reflector dish. The broadcast frequency signals (at UHF and VHF frequencies), may then be supplied on a separate cable to the television receiver or combined with the signals from the microwave signal pickup, if desired, and provided on a common cable that extends to the television receiver.

A loop section of electrical conductor may be connected by swivel connectors to the periphery of the dish reflector so that the loop section is in electrical contact with the dish reflector itself. The loop section may be formed to substantially conform to a portion, e.g., onehalf, of the circular periphery of the reflector dish. When the antenna of the invention is installed and the reflector dish properly oriented to maximize the reception of signals from a satellite, the loop section may be adjusted in position by the installer to optimize the reception of terrestrial broadcast signals by orienting the loop section in a position in which it best receives the full range of terrestrial broadcast frequencies.

The reflector dish may be and preferably is directly connected to a cable leading to the television receiver (or to a diplexer for a common cable). Where a balun transformer and ground block for the antenna are used, they may be manufactured as a single interface unit, and the interface unit may be connected by a ground wire to a grounding rod to enhance reception of the signal and ensure that the antenna is grounded for lightning protection. An amplifier and diplexer may also be combined with the ground block and balun to facilitate the use of a single cable to transmit both the terrestrial frequency signals and the satellite frequency signals to the receiver.

The antenna of the invention thus provides an unobtrusive, compact, low cost combined terrestrial and satellite broadcast antenna that receives both satellite and terrestrial transmission frequencies with reception quality for both that is equal to or closely approaches the reception qualities of separate specialized antennas.

Further objects, features and advantages of the invention will be apparent from the following detailed description when taken in conjunction with the accompanying drawings.

DETAILED DESCRIPTION OF THE INVENTION

Figure 1:
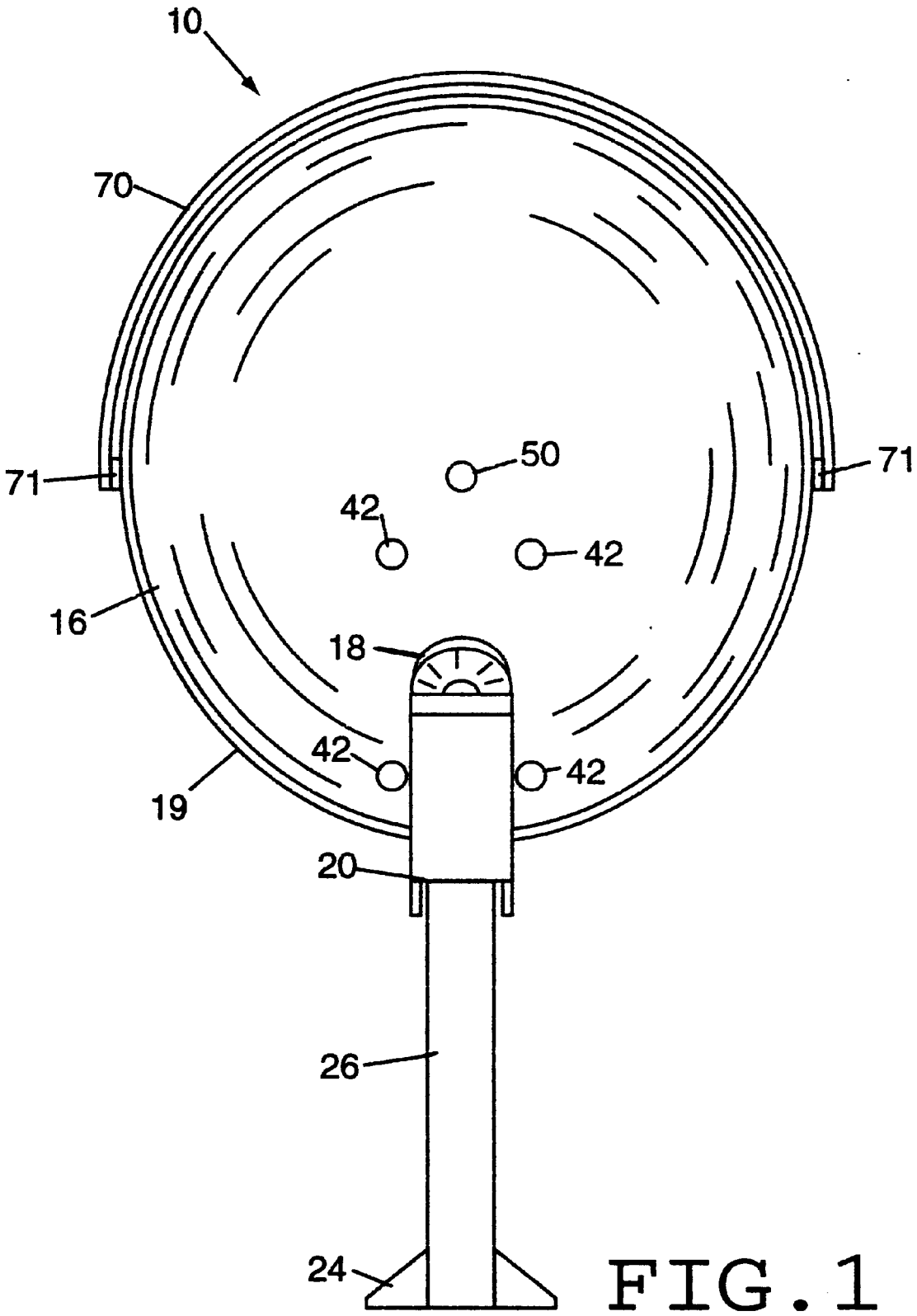
FIG. 1 is a front view of a combined satellite and terrestrial broadcast antenna in accordance with the invention.
Figure 2:
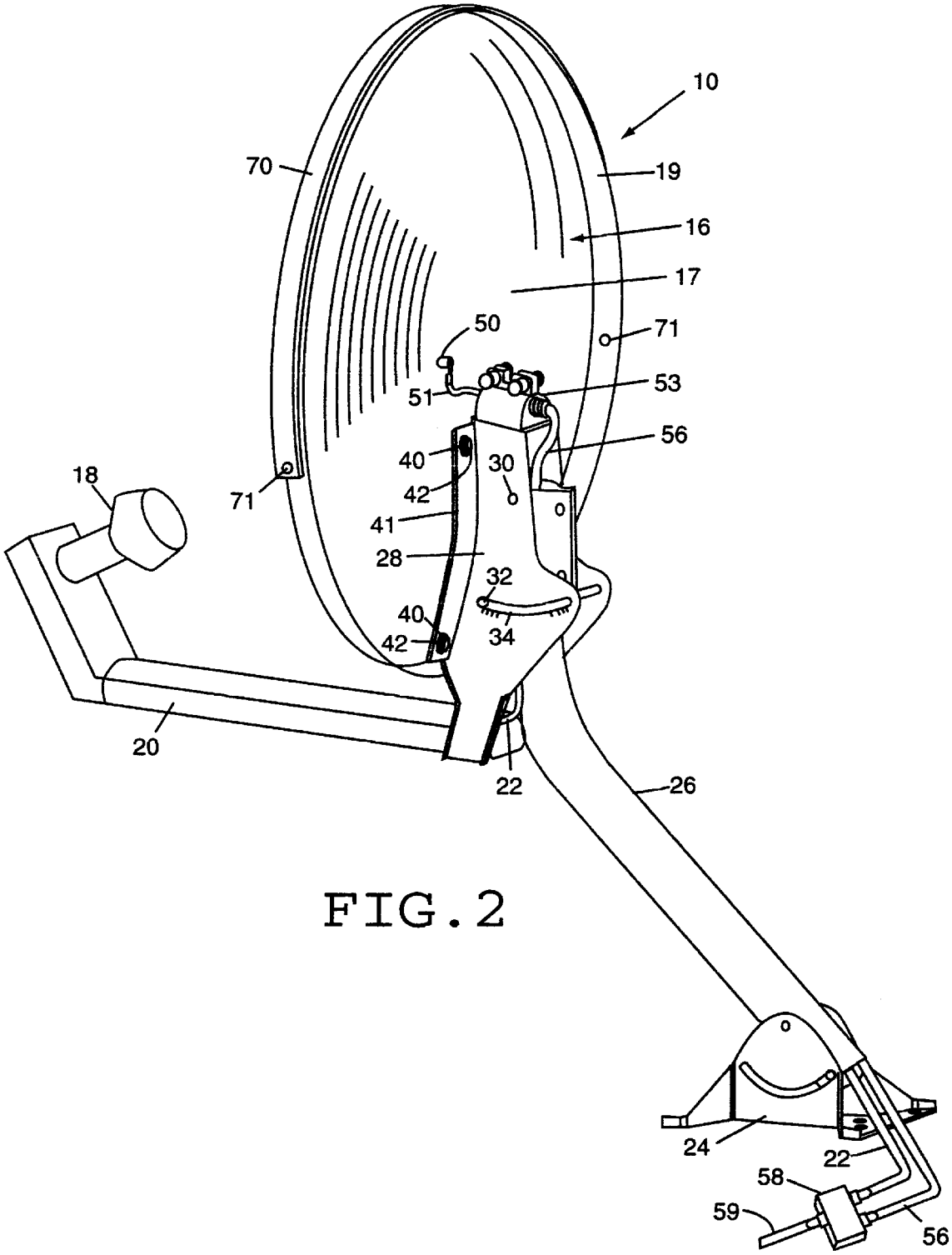
FIG. 2 is a side perspective view of the antenna of FIG. 1 showing the loop section in a position engaged against the periphery of the reflector dish of the antenna.
Figure 3:
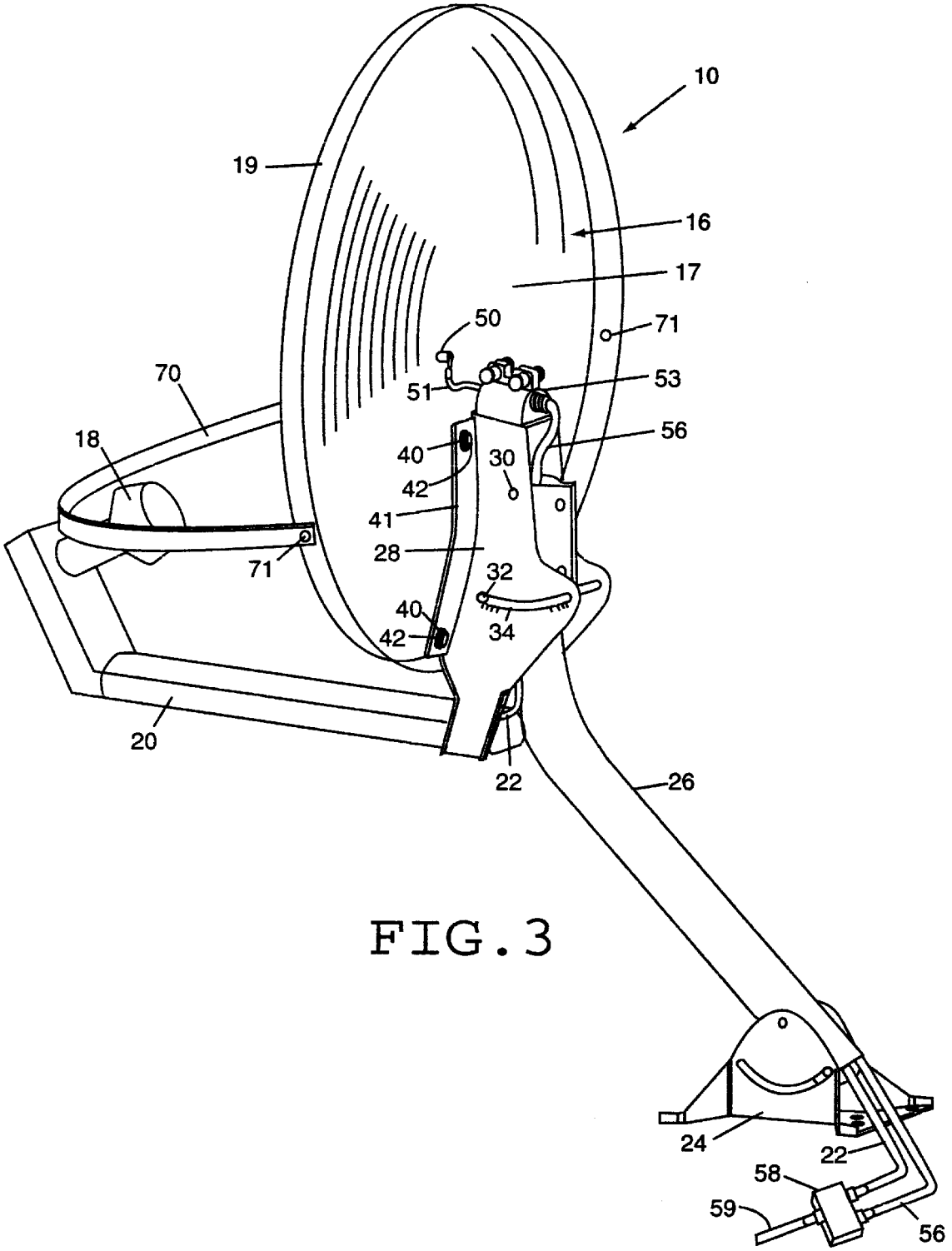
FIG. 3 is a perspective view of the antenna as in FIG. 2 showing the loop section moved to a forward position and in front of the reflecting face of the reflector dish.
Figure 4:
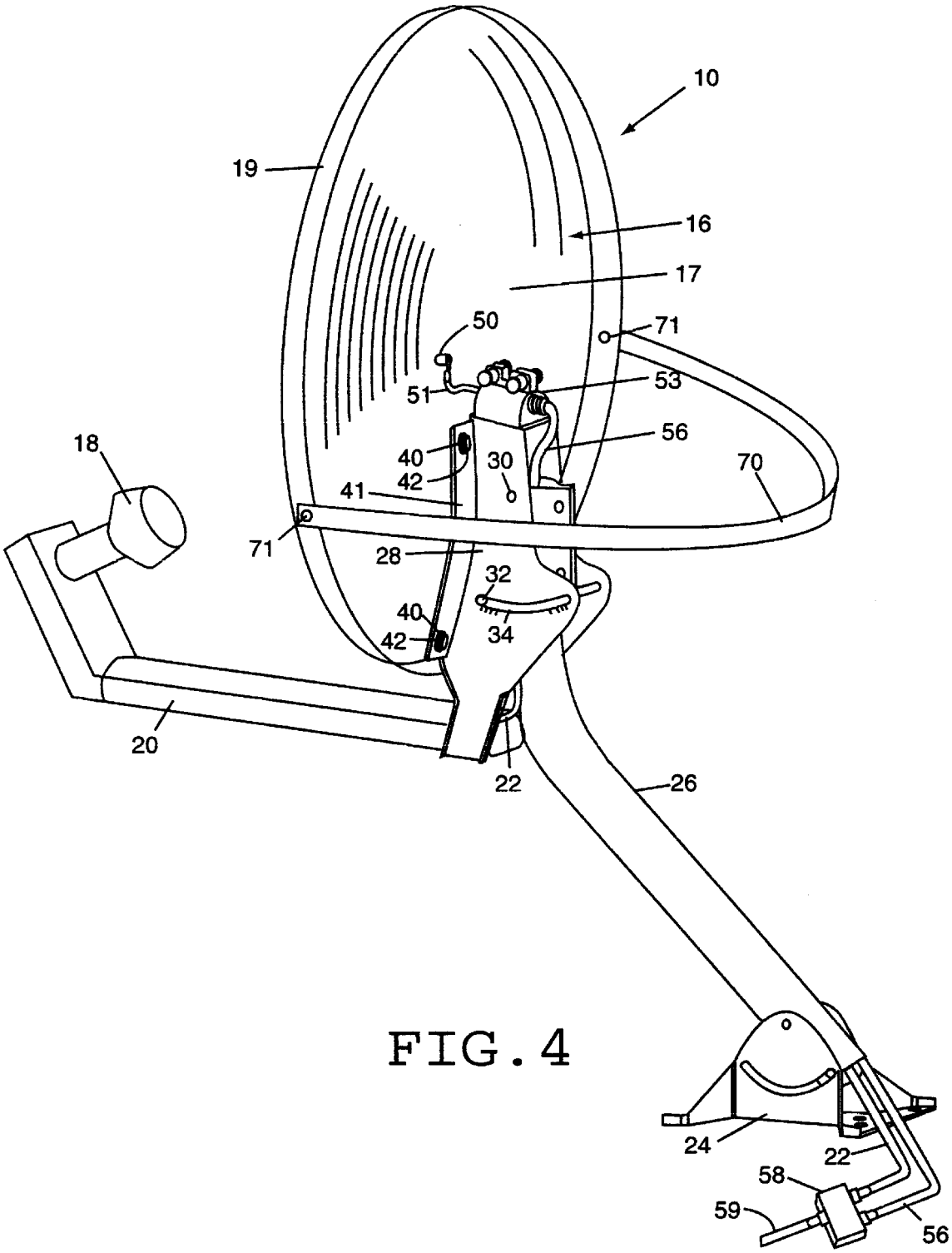
FIG. 4 is a perspective view of the antenna as in FIG. 2 showing the loop section moved to a position behind the reflecting surface of the reflector dish.

A combined satellite and terrestrial antenna in accordance with the present invention is shown generally at 10 in FIGS. 1–5. The antenna 10 includes a satellite reflector dish 16 which reflects a signal transmitted from a satellite onto a signal pick-up 18 which is supported in front of the front reflecting surface of the signal dish 16 by an arm 20. As shown in FIG. 2, a satellite antenna transmission line 22 carries the received satellite signal from the pick-up 18. The support structure for the antenna includes a base mounting bracket 24 which can be secured to, for example, a wall, roof, or other structure of a house. The support structure also includes a satellite antenna mast 26, secured to the base mounting bracket 24, which extends horizontally and vertically away from the structure (e.g., the side of a house) to which the base mounting bracket 24 is attached. The satellite reflector dish 16 and the arm 20 are attached to the satellite antenna mast 26 by a bracket 28 at the end of the mast 26 that is opposite to the base mounting bracket 24. As best shown in FIGS. 2–4, the bracket 28 is preferably rotatable about a pivot point 30 to adjust the elevation of the satellite dish 16. A nut 32 is attached to the end of a bolt, or other fastener, which extends through a slot 34 in the bracket 28. When the bolt 32 is loosened, the bracket 28 is allowed to rotate about the pivot point 30 to allow the dish 16 to be adjusted to a desired elevation, and degree markings may be placed adjacent to the slot 34 to allow the dish to be set easily and accurately at the desired elevation. When the bolt 32 is tightened, the dish 16 is fixed in position, for example, facing a satellite so as to provide the optimum reception of the satellite signal. The foregoing described support structure for the antenna is conventional and support structures of the type described in, for example, the aforesaid U.S. Pat. No. 5,604,508 may be utilized.

In the antenna 10 of the present invention, the reflector dish 16 functions both to reflect digital microwave satellite signals back to the pick-up 18 and to absorb and receive lower frequency terrestrial television broadcast signals in the UHF/VHF frequency range (which includes the FM radio band). The dish 16 is preferably formed of a metal, e.g., stamped galvanized sheet steel, which has adequate electrical conducting characteristics. If desired, other metals, or composite structures of conductors and supporting materials, such as fiberglass and metal laminates, may also be utilized. The reflector dish 16 is preferably formed with a conventional construction in conventional sizes (e.g., 18 inch diameter for digital satellite signals) having a parabolic central section 17 with an integral folded over peripheral rim 19 that adds rigidity to the overall dish structure. The sheet metal of the dish 16 is preferably painted or coated, for example, with a baked enamel paint, to protect it from the elements and for aesthetic reasons.

In conventional satellite antenna systems, the attachment of the dish 16 to the mounting bracket 28 provides an electrical connection between the mounting bracket and the dish, and these structures are conventionally connected to ground by a ground wire for lightning protection. In the present invention, the reflector dish 16 is electrically insulated from the mounting bracket 28 and is therefore electrically isolated from the rest of the mounting structure and from ground. Insulating washers 40 may be mounted between the back of the parabolic central portion 17 and flat mounting panels 41 of the bracket 28. The insulating washers 40 may be formed of various electrically insulating materials such as synthetic rubber, plastics, etc. Connectors 42, such as nuts 42A and bolts 42B, attach the dish 17 to the panels 41 of the mounting bracket 28. To maintain electrical isolation of the dish 16 from the bracket 28, the connectors 42 preferably have the insulating washers 40 mounted on either side of the panels 41 between metal portions of the connectors and the adjacent surfaces of the dish 16 and the mounting panels 41. Non-metallic connectors may also be utilized to mount the dish to the bracket 28. To provide an electrical connection to the metal of the dish 16, a contact connector 50 is engaged through a hole in the dish portion 17 and is electrically connected to the metal of the dish. An electrical conducting line 51 extends from the connector 50 to an interface unit 53, which may comprise, for example, a combined grounding block and balun transformer. The output signal from the interface unit 53 is provided on an output line 56 to a diplexer/signal combiner 58, which also receives the line 22 from the pick-up 18. The diplexer 58 may be utilized to combine the signals on the lines 22 and 56 to a single transmission line 59 (e.g., coaxial cable) which extends back to the television receiver (alternatively, the two lines 22 and 56 may be brought separately to the receiver). If desired, an amplifier and diplexer may be combined with the ground block and the balun in the interface unit 53, with the connecting cable 22 extending to the interface unit 53 so that a single cable may carry both the satellite and terrestrial signals back to the receiver.

It has been found, in accordance with the present invention, that the electrical isolation of the metal reflecting dish 16 and the connection of the dish to a receiver, enables high-quality VHF/UHF/FM frequency signal reception that is comparable to the antenna reception provided by specialized broadcast television reception antennas. Moreover, the reception provided at such frequencies is not critically dependent of the orientation of the dish 16, so that the dish may be positioned as appropriate to optimize the reception of signals from a satellite.

The reception of the terrestrial broadcast signals may be further enhanced by utilizing a loop section 70, formed of a conductor, such as steel or copper, which is connected at its ends by swivel connectors 71 to the rim 19 of the dish 16. The swivel connectors 71 preferably make electrical contact both with the loop section 70 and with the metal of the rim 19, which is formed integrally with and is in electrical continuity with the parabolic central portion 17 of the dish 16. Thus, signals picked up by the loop section 70 will be transmitted to the dish central portion 17 and transmitted via the connector 15 and the line 51 to the interface unit 53. The loop section 70 is preferably formed to have a semicircular shape conforming to the outer periphery of the dish 16 as defined by the rim 19 so that it can be moved to a position compactly adjacent to the rim 19, as illustrated in FIGS. 1 and 2. The swivel connectors 71 allow the loop section 70 to be rotated to other positions which can be selected by the installer to optimize the reception provided by the antenna. FIG. 3 illustrates the positioning of the loop section 70 to the front of the dish 16, ahead of the front reflecting face of the dish but above the pick-up 18 so that the loop section 70 does not interfere with the operation of the pick-up 18. FIG. 4 illustrates the rotation of the loop section backwardly about the swivel connectors 71 to a position behind the dish 16. The two positions of the loop section 70 illustrated in FIGS. 3 and 4 are simply illustrative, and it is understood that the loop section 70 may be rotated to any desired position within its range of motion that optimizes reception. The swivel connectors 71 preferably provide a frictional engagement between the loop section 70 and the rim 19 so that the loop section 70, once placed in a desired position, will remain fixed in that position against the force of wind, rain, snow, ice and other weather conditions.

Figure 5:
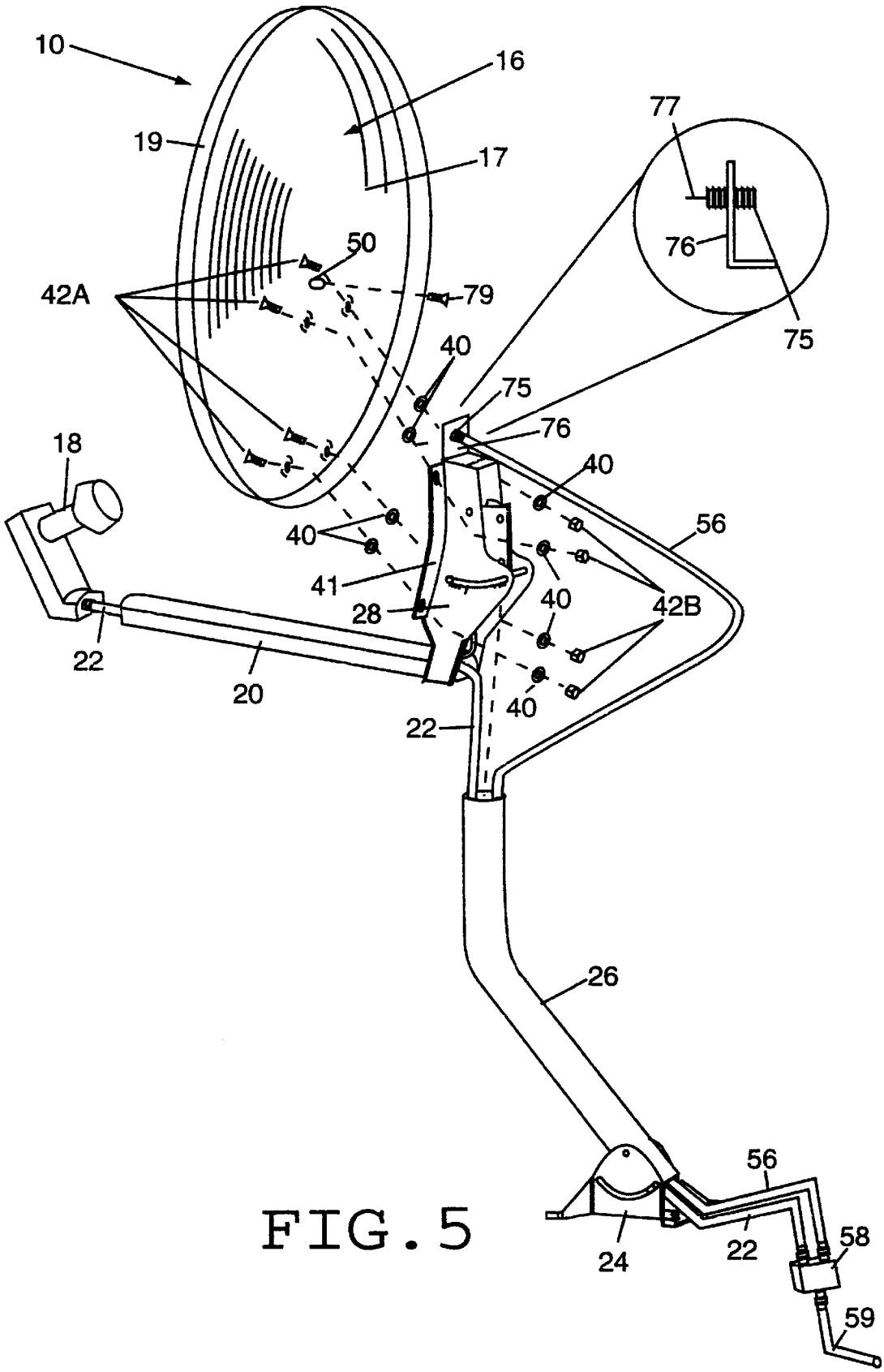
FIG. 5 is an exploded view of the antenna of the invention with a direct connection to the reflector dish.

An exploded view of the antenna 10 is shown in FIG. 5 illustrating the assembly of the various parts thereof. The antenna 10 is shown in FIG. 5 without the optional loop section 70 and illustrating the use of a direct connection to the dish 16 rather than the interface unit 53. The coaxial cable 56 is coupled to a connector 75 mounted on a bracket 76 which is itself secured (e.g., by welding) to the top of the bracket 28. The connector 75 may be a conventional F-61 (F to chassis) connector which has a center conductor 77. During assembly, the center conductor 77 is engaged by a bolt 79 as the bolt is threaded into the nut 50 (e.g., a PEM nut with a tapped central hole) to provide a good electrical connection between the center conductor 77 (and thus the central conductor of the coaxial cable 56) and the dish 16.

It is thus seen that the antenna in accordance with the present invention is a structure which occupies essentially the same volume with the same appearance as a conventional satellite dish antenna, and that may be formed with the same structural components as conventional satellite dish antennas so that reception of satellite signals is optimized. The additional features of the invention which enable reception of terrestrial broadcast signals are significantly lower in cost than the separate components that are required to form a dedicated terrestrial antenna in a conventional manner, while nonetheless providing reception of terrestrial broadcast signals at a quality level comparable to separate specialized UHF/VHF antennas.

It is understood that the invention is not confined to the particular construction and arrangement of parts set forth herein as illustrative, but embraces all such modified forms thereof as come within the scope of the following claims.

What is claimed is:

1. A combined satellite and terrestrial antenna comprising:

(a) a reflector dish formed of a conducting metal;

(b) a satellite signal pick-up for receiving satellite transmission signals reflected from the reflector dish;

(c) support structure connected to and supporting the reflector dish and the satellite signal pick-up with the pick-up in a desired position with respect to the dish reflector;

(d) electrical insulation between the reflector dish and the support structure to electrically insulate the reflector dish from the support structural; and (e) a connector attached to the dish and in electrical contact therewith, and a signal transmission line connected to the connector to carry UHF/VHF signals absorbed by the reflector dish.

2. The antenna of claim 1 wherein the reflector dish is formed of stamped sheet metal.

3. The antenna of claim 1 wherein the signal transmission line connected to the connector that is attached to the reflector dish is a coaxial cable having a central conductor, and wherein the connector electrically connects the reflector dish to the central conductor of the coaxial cable.

4. The antenna of claim 3 further including a diplexer connected o the signal transmission line from the connector and the signal transmission line from the satellite signal pick-up and providing an output signal on a common transmission line.

5. A combined satellite and terrestrial antenna comprising:

(a) a reflector dish formed of a conducting metal;

(b) a satellite signal pick-up for receiving satellite transmission signals reflected from the reflector dish;

(c) support structure connected to and supporting the reflector dish and the satellite signal pick-up with the pick-up in a desired position with respect to the dish reflector;

(d) electrical insulation between the reflector dish and the support structure to electrically insulate the reflector dish from the support structure;

(e) a connector attached to the dish and in electrical contact therewith, and a signal transmission line connected to the connector to carry UHF/VHF signals absorbed by the reflector dish; and (f) a loop section of conducting metal connected at its ends by swivel connectors to a periphery of the reflector dish and providing electrical contact between the loop and the dish, the loop section rotatable about the swivel connectors to position in which the loop section is in front of the dish to position in which the loop section is behind the dish.

6. The antenna of claim 5 wherein the loop section is formed to have a semicircular shape which substantially conforms to the outer periphery of the reflector dish.

7. A combined satellite and terrestrial antenna comprising;

(a) a reflector dish formed of a conducting metal;

(b) a satellite signal pick-up for receiving satellite transmission signals reflected from the reflector dish;

(c) support structure connected to and supporting the reflector dish and the satellite signal pick-up with the pick-up in a desired position with respect to the dish reflector;

(d) electrical insulation between the reflector dish and the support structure to electrically insulate the reflector dish from the support structure;

(e) a connector attached to the dish and in electrical contact therewith, and a signal transmission line connected to the connector to carry UHF/VHF signals absorbed by the reflector dish; and (f) an interface unit comprising a grounding block and a balun transformer mounted to the support structure, and connected to the transmission line that extends to the connector at the dish, and providing an output on a transmission line.

8. The antenna of claim 7 wherein the interface unit further includes an amplifier and diplexer and including a transmission line extending from the satellite signal pick-up to the interface unit and connected thereto, the interface unit amplifying and combining the signals on the transmission lines from the dish and from the satellite pick-up and providing output signal on the common transmission line.

* * * * *

UNITED STATES PATENT AND TRADEMARK OFFICE

CERTIFICATE OF CORRECTION

PATENT NO. : 5,933,123

DATED : August 3, 1999

INVENTOR(S) : John R. Kaul

It is certified that error appears in the above-indentified patent and that said Letters Patent is hereby corrected as shown below:

In column 1, line 45 of the patent, delete "is" before "mounting system,"

In column 6, line 45, Claim 2(f) of the patent, --section-- should be inserted after the first occurrence of "loop"

In column 6, lines 46 and 47, Claim 2(f) of the patent, both occurrences of "position" should be --positions--

In column 8, line 5, Claim 8 of the patent, --an-- should be inserted after "providing"

Signed and Sealed this

Twenty-second Day of August, 2000

*Attest:*

Q. TODD DICKINSON

*Attesting Officer*

*Director of Patents and Trademarks*